US007171714B2

(12) United States Patent
Pyo et al.

(10) Patent No.: US 7,171,714 B2
(45) Date of Patent: Feb. 6, 2007

(54) METHOD OF CONTROLLING A WASHING MACHINE

(75) Inventors: Sang-yeon Pyo, Suwon (KR); Hyung-kyoon Kim, Suwon (KR); Chan-woo Park, Anyang (KR); Myung-gyu Lee, Suwon (KR); Seon-woo Park, Suwon (KR); Hyun-sook Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 372 days.

(21) Appl. No.: 10/216,238

(22) Filed: Aug. 12, 2002

(65) Prior Publication Data

US 2003/0154558 A1 Aug. 21, 2003

(30) Foreign Application Priority Data

Feb. 18, 2002 (KR) ..... 2002-8439

(51) Int. Cl.
*D06F 33/00* (2006.01)

(52) U.S. Cl. ..... 8/159

(58) Field of Classification Search ..... 8/158–159; 68/131–134, 12.04, 12.05
See application file for complete search history.

(56) References Cited

U.S. PATENT DOCUMENTS

| | | | |
|---|---|---|---|
| 1,741,191 | A | 12/1929 | Kirby |
| 2,145,453 | A | 1/1939 | Miller |
| 2,145,454 | A | 1/1939 | Miller |
| 2,509,264 | A | 5/1950 | Cox |
| 2,645,111 | A | 7/1953 | Fields |
| 2,695,510 | A | 11/1954 | Clark |
| 2,715,826 | A | 8/1955 | Kirby |
| 2,831,333 | A | 4/1958 | Smith |
| 2,902,851 | A | 9/1959 | Fields |
| 2,902,852 | A | 9/1959 | Fields |
| 2,921,460 | A | 1/1960 | Aberle |
| 2,931,201 | A | 4/1960 | Hubbard |

(Continued)

FOREIGN PATENT DOCUMENTS

| | | |
|---|---|---|
| EP | 0 883 004 | 4/1998 |

(Continued)

OTHER PUBLICATIONS

U.S. Appl. No. 10/197,332, filed Jul. 18, 2002, Hyung-Kyoon Kim et al., Samsung Electronic Co., Ltd.

(Continued)

*Primary Examiner*—Joseph L. Perrin
(74) *Attorney, Agent, or Firm*—Staas & Halsey LLP

(57) ABSTRACT

A method of controlling a washing machine is provided. The washing machine control method executes a washing process with a wobbling device. In the method, an operation of causing a washboard to wobble and an operation of rotating a spin-drying tub in the washing process are alternately performed. An operation of causing a washboard to wobble in a wobbling position and an operation of rotating a spin-drying tub in a washing process several times to mix laundry is performed, such that upper laundry and lower laundry can be uniformly washed, thus improving a laundry cleaning performance. Further, entangled laundry can be prevented from being rinsed by causing the washboard to wobble in the wobbling position before rinsing water is supplied.

26 Claims, 13 Drawing Sheets

U.S. PATENT DOCUMENTS

| | | | | | |
|---|---|---|---|---|---|
| 2,948,128 | A | | 8/1960 | Smith | |
| 3,091,953 | A | | 6/1963 | Hubbard | |
| 3,102,408 | A | | 9/1963 | Pelensky | |
| 3,102,410 | A | | 9/1963 | Doyle | |
| 3,290,908 | A | | 12/1966 | McAllister et al. | |
| 3,412,621 | A | | 11/1968 | Jacobs | |
| 4,321,809 | A | | 3/1982 | Bochan | |
| 4,428,088 | A | | 1/1984 | Getz et al. | |
| 4,489,574 | A | | 12/1984 | Spendel | |
| 4,779,430 | A | | 10/1988 | Thuruta et al. | |
| 4,862,710 | A | | 9/1989 | Torita et al. | |
| 5,000,015 | A | | 3/1991 | Nakamura et al. | |
| 5,144,819 | A | | 9/1992 | Hiyama et al. | |
| 5,297,307 | A | | 3/1994 | Baek | |
| 5,353,612 | A | | 10/1994 | Noguchi et al. | |
| 5,460,018 | A | * | 10/1995 | Werner et al. | 68/23.6 |
| 5,504,955 | A | | 4/1996 | Mueller et al. | 8/158 |
| 5,507,053 | A | * | 4/1996 | Mueller et al. | 8/158 |
| 5,737,790 | A | | 4/1998 | Badger et al. | |
| 5,743,115 | A | | 4/1998 | Hasimoto | |
| 5,768,728 | A | | 6/1998 | Harwood et al. | |
| 5,791,167 | A | | 8/1998 | Wyatt et al. | |
| 5,943,885 | A | | 8/1999 | Park | |
| 5,946,949 | A | | 9/1999 | Park et al. | |
| 6,070,439 | A | | 6/2000 | Jung | |
| 6,115,863 | A | * | 9/2000 | Mason et al. | 8/159 |
| 6,227,013 | B1 | * | 5/2001 | Wyatt-Smith | 68/134 |
| 6,460,381 | B1 | | 10/2002 | Yoshida et al. | |
| 6,557,382 | B1 | | 5/2003 | Koike et al. | |

FOREIGN PATENT DOCUMENTS

| | | |
|---|---|---|
| JP | 64-22286 | 1/1989 |
| JP | 7-31786 | 2/1995 |

OTHER PUBLICATIONS

U.S. Appl. No. 10/197,336, filed Jul. 18, 2002, Hyung-Kyoon Kim et al., Samsung Electronic Co., Ltd.
U.S. Appl. No. 10/216,430, filed Aug. 12, 2002, Hyun-Sook Kim et al., Samsung Electronic Co., Ltd.

* cited by examiner

METHOD OF CONTROLLING A WASHING MACHINE

CROSS-REFERENCE TO RELATED APPLICATIONS

This application claims the benefit of Korean Application No. 2002-8439, filed Feb. 18, 2002, in the Korean Industrial Property Office, the disclosure of which is incorporated herein by reference.

BACKGROUND OF THE INVENTION

1. Field of the Invention

The present invention relates generally to a method of controlling a washing machine, and more particularly to a method of controlling a washing machine, which can wash laundry by causing a washboard installed on the inner surface of the bottom of a spin-drying tub to wobble.

2. Description of the Related Art

Generally, washing machines are devices for washing laundry by rotating a cylindrical rotating tub in which laundry and washing water are contained. Such washing machines are classified into two types: a drum type in which a rotating tub is horizontally arranged to wash laundry by upwardly raising laundry along the inner circumferential surface of the rotating tub and dropping the laundry while the rotating tub rotates in a normal direction or a reverse direction around a horizontal shaft, and a vertical shaft type in which a spin-drying tub having a pulsator formed therein is vertically arranged to wash laundry by using a water stream generated by the pulsator while the spin-drying tub rotates in a normal direction or a reverse direction around a vertical shaft.

FIG. 1 is a view showing the construction of a conventional vertical shaft washing machine having a pulsator to wash laundry. As shown in FIG. 1, the conventional vertical shaft washing machine having a pulsator comprises a housing 1 to form an external shape of the washing machine, a cylindrical washing tub 2 vertically arranged within the housing 1 to contain washing water therein, a cylindrical spin-drying tub 3 rotatably arranged within the cylindrical washing tub 2 and provided with a plurality of perforation holes 3*c* formed in an outer surface of the cylindrical spin-drying tub 3, a pulsator 4 installed in a lower portion of the cylindrical spin-drying tub 3 to generate a washing water stream, and a reversible drive motor 5 and a power transmission device 6 which are installed beneath the cylindrical washing tub 2 to selectively rotate the pulsator 4 and the cylindrical spin-drying tub 3.

The housing 1 is opened at a top of the housing 1 to allow a user to put laundry in the cylindrical spin-drying tub 3 or take out the laundry from the cylindrical spin-drying tub 3; A door 7 is hingedly attached to the opened top of the housing 1 to selectively open and shut the cylindrical spin-drying tub 3. Further, a drain hose 8 extended to an outside of the housing 1 is connected to a bottom of the cylindrical washing tub 2 so as to drain the washing water contained in the cylindrical washing tub 2 to the outside when a washing operation is completed.

A spin-drying shaft support 9 is installed beneath the bottom 3*a* of the cylindrical spin-drying tub 3 to couple a spin-drying shaft 6*a* of the power transmission device 6 with the cylindrical spin-drying tub 3, thus allowing the cylindrical spin-drying tub 3 to rotate according to the rotation of the spin-drying shaft 6*a* in a spin-drying process. Further, a washing shaft 6*b* of the power transmission device 6, which is installed to penetrate through the spin-drying shaft 6*a*, is coupled to the pulsator 4 arranged on the bottom of the cylindrical spin-drying tub 3 to rotate the pulsator 4 by rotating the washing shaft 6*b* in a washing process.

In the convention vertical shaft washing machine having the pulsator 4 constructed as described above, when the washing machine is operated after laundry is put in the cylindrical spin-drying tub 3, water is supplied to the cylindrical washing tub 2, and the pulsator 4 is alternately rotated in the normal direction and the reverse direction by the rotation of the reversible drive motor 5 and the washing shaft 6*b* of the power transmission device 6. Due to the rotation of the pulsator 4 in the normal direction and the reverse direction, a washing water stream is generated in the normal direction and the reverse direction, so laundry rubs against a surface of the cylindrical spin-drying tub 3 while being moved together with the washing water stream, thereby allowing laundry to be washed.

After a predetermined period of time elapses and a washing process is completed, a rinsing process of draining the washing water through the drain hose 8 and removing detergent from the laundry is carried out. Then, the cylindrical spin-drying tub 3 is rotated in one direction at a high speed by a rotation of the reversible drive motor 5 and the spin-drying shaft 6*a* of the power transmission device 6 to dry the laundry, thus completing the washing of the laundry.

However, the conventional vertical shaft washing machine operated as described above washes laundry using washing water streams generated by alternate rotation of the pulsator in the normal and in the reverse directions. Accordingly, laundry is moved alternately in the normal and reverse directions, so the laundry can become twisted and entangled. Consequently, the conventional vertical shaft washing machine is problematic in that laundry is easily worn out or damaged, and the user experiences inconvenience and can waste time untangling the laundry when the washing of the laundry is completed.

Meanwhile, the conventional washing machine using the pulsator is problematic in that the conventional washing machine operates by alternately rotating the pulsator in the normal and the reverse directions at short time intervals in the washing process, thus increasing power consumption due to alternate activations of the motor in both directions, which shortening the life span of the motor due to the above described operations.

Further, the conventional washing machine using the pulsator must fill the washing tub with a relatively large amount of the washing water so as to wash the laundry by agitating the laundry left and right by the washing water stream. Therefore, the amount of water used is increased, and the amount of detergent used is inevitably increased due to the increase of the amount of water used. Accordingly, the conventional washing machine is problematic in that the conventional washing machine causes an excessive waste of the wash water, which causes environmental pollution due to the increase of the amount of detergent used. According to recent trends to saving water and tightening restrictions against environmental pollution, the above disadvantages of the conventional washing machine are problems, which urgently must be solved.

In consideration of these problems, there recently was proposed a method of washing laundry by applying mechanical impacts to the laundry using a wobbling device, which can relieve the above problems.

However, the above-described method using a wobbling device also requires a control method increasing cleaning performance in proportion to the reduction of the amounts of both washing water and detergent used, and preventing the entanglement of laundry. Further, if a user does not immediately take out laundry from the washing tub after a spin-drying process is completed, the entangled laundry becomes stiffened. Therefore, a method is required to loosen the laundry to allow the user to later easily take out the laundry, and minimizing the generation of wrinkles of the laundry.

SUMMARY OF THE INVENTION

Accordingly, a method of controlling a washing machine is provided, which can save washing water and improve cleaning performance by alternately performing an operation of causing a washboard to wobble and an operation of rotating a spin-drying tub.

Another object is to provide a method of controlling a washing machine, which can prevent the laundry from being entangled by performing an operation of rotating a spin-drying tub and an operation of causing a washboard to wobble before water to be used in a rinsing process is supplied.

A further object is to provide a method of controlling a washing machine, which can allow a user to easily take out the laundry by performing an operation of causing a washboard to wobble to loosen the laundry after a spin-drying process is completed.

Additional objects and advantages of the invention will be set forth in part in the description which follows and, in part, will be obvious from the description, or may be learned by practice of the invention.

In order to accomplish the above and other objects, an embodiment of the present invention provides a method of controlling a washing machine, the washing machine executing a washing process with a wobbling device, the method comprising alternately causing a washboard to wobble; and rotating a spin-drying tub in the washing process.

Further, there is provided a method of controlling a washing machine, the washing machine executing a washing process and a rinsing process with a wobbling device, the method comprising rotating a spin-drying tub after the washing process is completed; causing a washboard to wobble after rotation of the spin-drying tub is completed; and supplying water to be used in the rinsing process.

Further, there is provided a method of controlling a washing machine, the washing machine executing a spin-drying process with a wobbling device, the method comprising causing a washboard to wobble after the spin-drying process is completed.

BRIEF DESCRIPTION OF THE DRAWINGS

These and other objects and advantages of the invention will become apparent and more readily appreciated from the following description of the preferred embodiments, taken in conjunction with the accompanying drawings of which:

FIGS. 8A to 8E are flowcharts of a method of controlling a washing machine according to an embodiment of the present invention, in which FIG. 8A shows a washing process, FIG. 8B shows a rinsing drying process and a shower rinsing process, FIG. 8C and FIG. 8D show a main rinsing process, FIG. 8E shows a main spin-drying process.

DETAILED DESCRIPTION OF THE PREFERRED EMBODIMENTS

Figure 1:
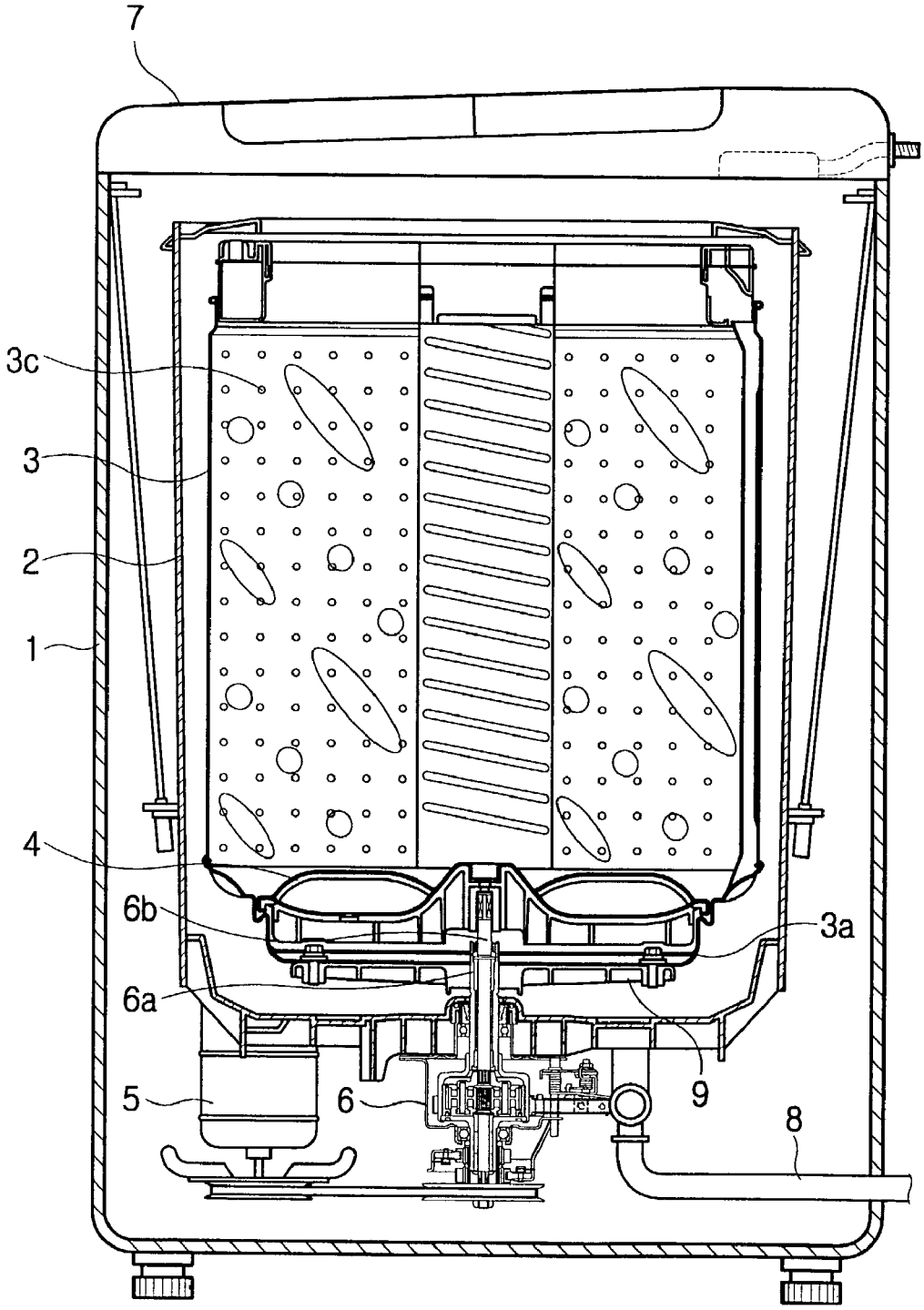
FIG. 1 (PRIOR ART)
FIG. 1 is a vertical sectional view of a conventional vertical shaft washing machine having a pulsator.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2A:
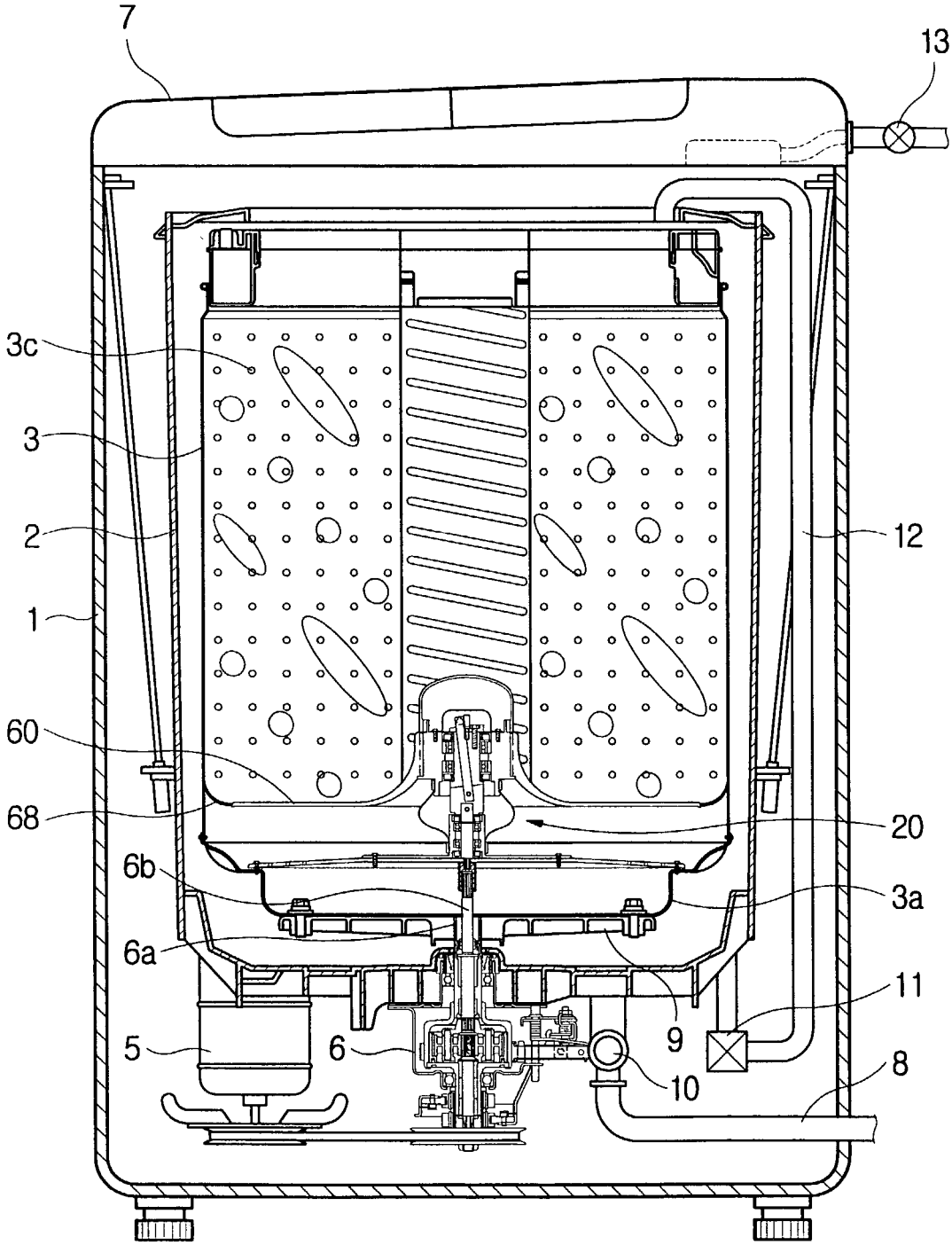
FIGS. 2A and 2B are vertical sectional views of a vertical shaft washing machine having a wobbling device, FIG. 2A showing that a wobbling device is switched to a leveling position, FIG. 2B showing that the wobbling device is switched to a wobbling position.
Figure 2B:
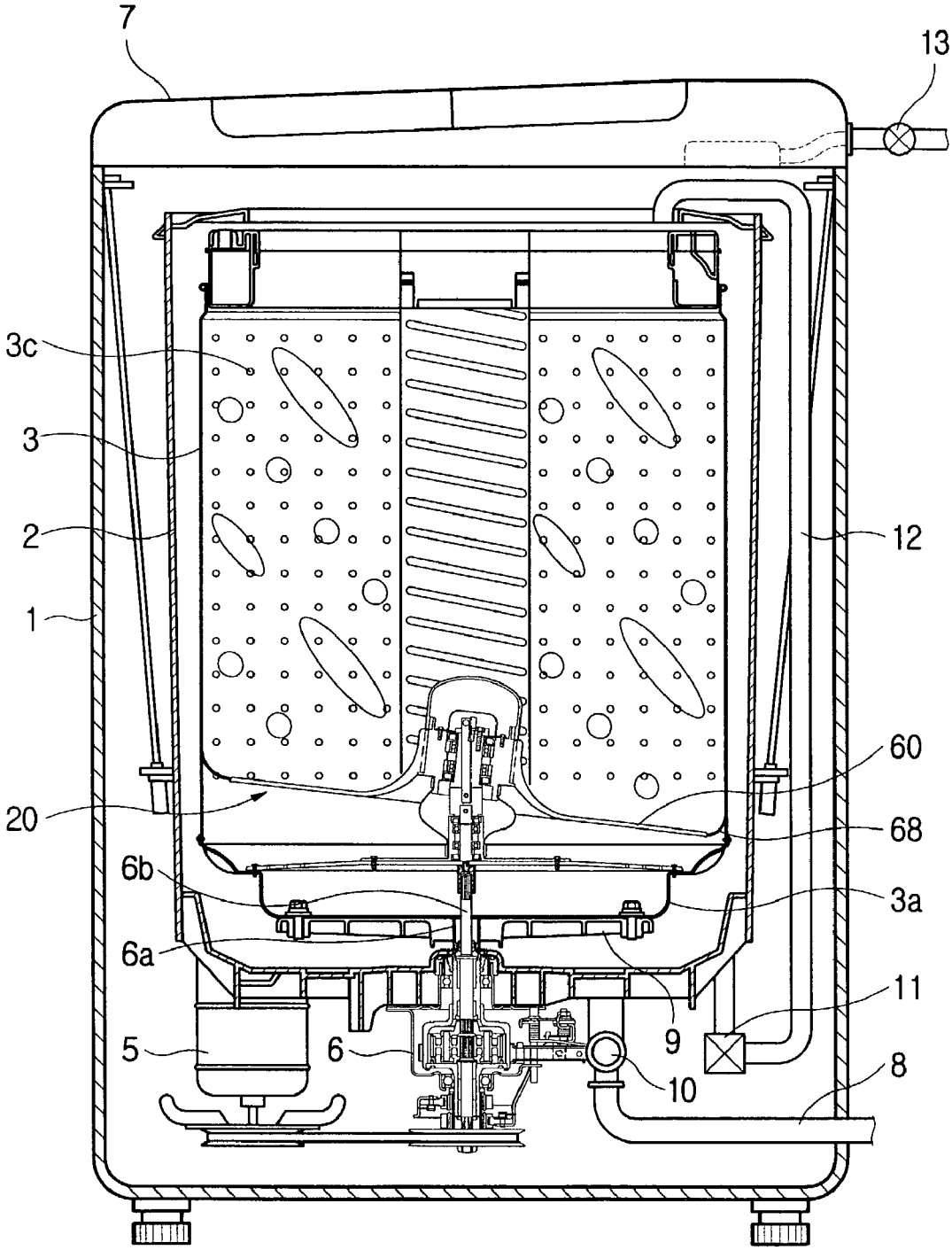

FIGS. 2A and 2B are vertical sectional views of a vertical shaft washing machine having a wobbling device, FIG. 2A showing that a wobbling device is switched to a leveling position, FIG. 2B showing that the wobbling device is switched to a wobbling position. In the wobbling position, the wobbling device is switched to cause a washboard to be inclined, thus enabling the washboard to wobble upwardly and downwardly. In the leveling position, the wobbling device is switched to arrange the washboard horizontally, thus preventing the washboard from wobbling.

As shown in FIGS. 2A and 2B, the vertical shaft washing machine comprises a washing tub 2 installed within a housing 1, a spin-drying tub 3 installed within the washing tub 2 and provided with a plurality of perforation holes 3*c* formed therein, and a drive motor 5 and a power transmission device 6 which are installed beneath the washing tub 2. In this case, a wobbling device 20 is arranged within the spin-drying tub 3.

Further, there are installed under the washing tub 2 a drain hose 8 extended to the outside of the housing 1 to drain water contained in the washing tub 2 to the outside when washing is completed and a circulation pump 11 and a return pipe 12 to circulate the washing water supplied to the washing tub 2 to an upper portion of the washing tub 2 so as to reduce the amount of water used. Further, a water supply valve 13 is disposed in a water supply pipe connected to an external hydrant.

A spin-drying shaft support 9 is installed beneath the bottom 3*a* of the spin-drying tub 3, and a spin-drying shaft 6*a* of the power transmission device 6 is coupled with a center portion of the spin-drying shaft support 9 to rotate the spin-drying tub 3. A washing shaft 6*b* is installed within the spin-drying shaft 6*a* while penetrating through the spin-drying shaft 6*a*, with an upper portion of the washing shaft 6*b* slightly extended upwardly from the spin-drying shaft 6*a* such that the washing shaft 6*b* can be coupled with the wobbling device 20.

The wobbling device 20 is installed on an inner surface of the bottom 3*a* of the spin-drying tub 3. When the wobbling device 20 is switched to the wobbling position, as shown in FIG. 2B, the laundry moves upwardly and downwardly to be washed. Further, when the wobbling device 20 is switched to the leveling position, as shown in FIG. 2A, the wobbling device 20 rotates together with the spin-drying tub 3 to dry the laundry.

Figure 3:
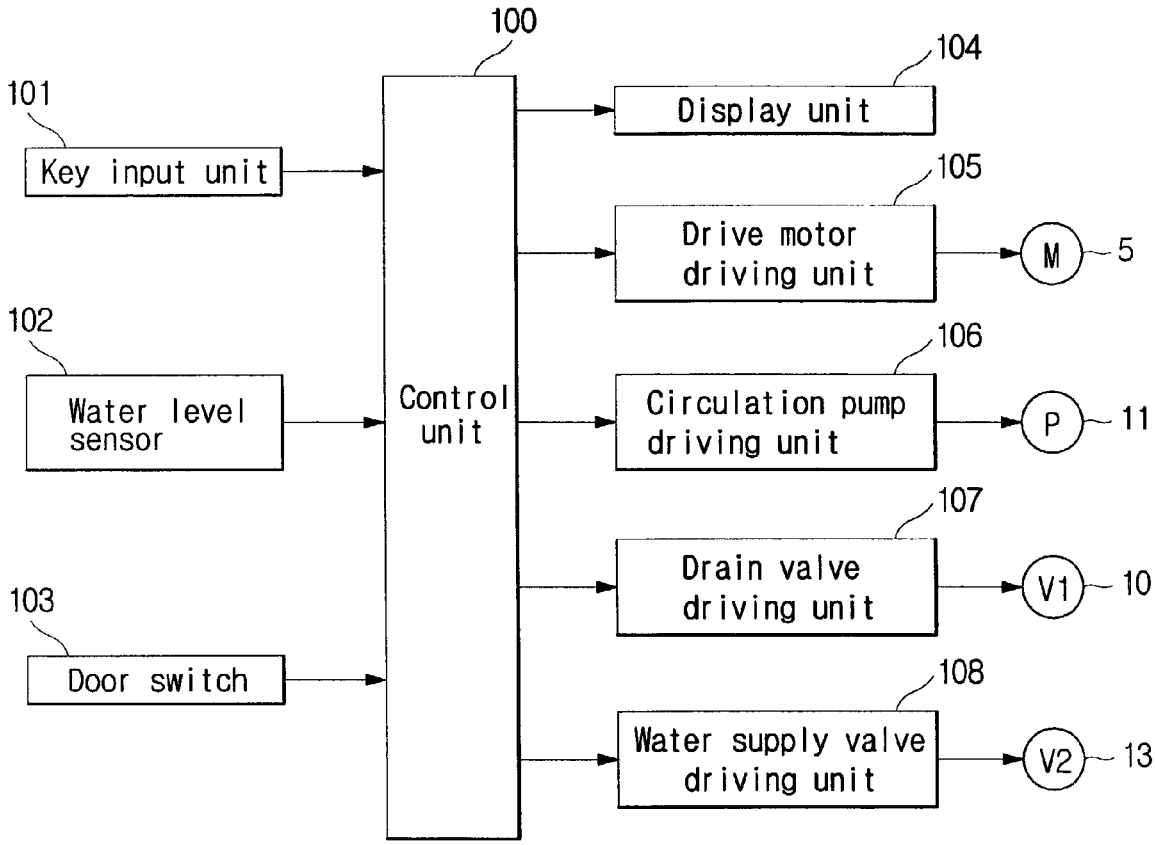
FIG. 3 is a block diagram of a washing machine of an embodiment of the present invention.

FIG. 3 is a block diagram of a washing machine of an embodiment of the present invention.

As shown in FIG. 3, the washing machine comprises a control unit 100 to control entire washing operations using the wobbling device. An input terminal of the control unit 100 is connected to a key input unit 101 to allow a user to input washing information including a washing course, a water level sensor 102 to sense the level of the washing water supplied to the washing tub 2, and a door switch 103 to sense the opening/shutting of a door 7. An output terminal of the control unit 100 is connected to a display unit 104 to display operation states of the washing machine, a drive motor driving unit 105 to drive a drive motor 5, a circulation pump driving unit 106 to drive a circulation pump 11, a drain valve driving unit 107 to drive a drain valve 10, and a water supply valve driving unit 108 to drive a water supply valve 13.

Figure 4:
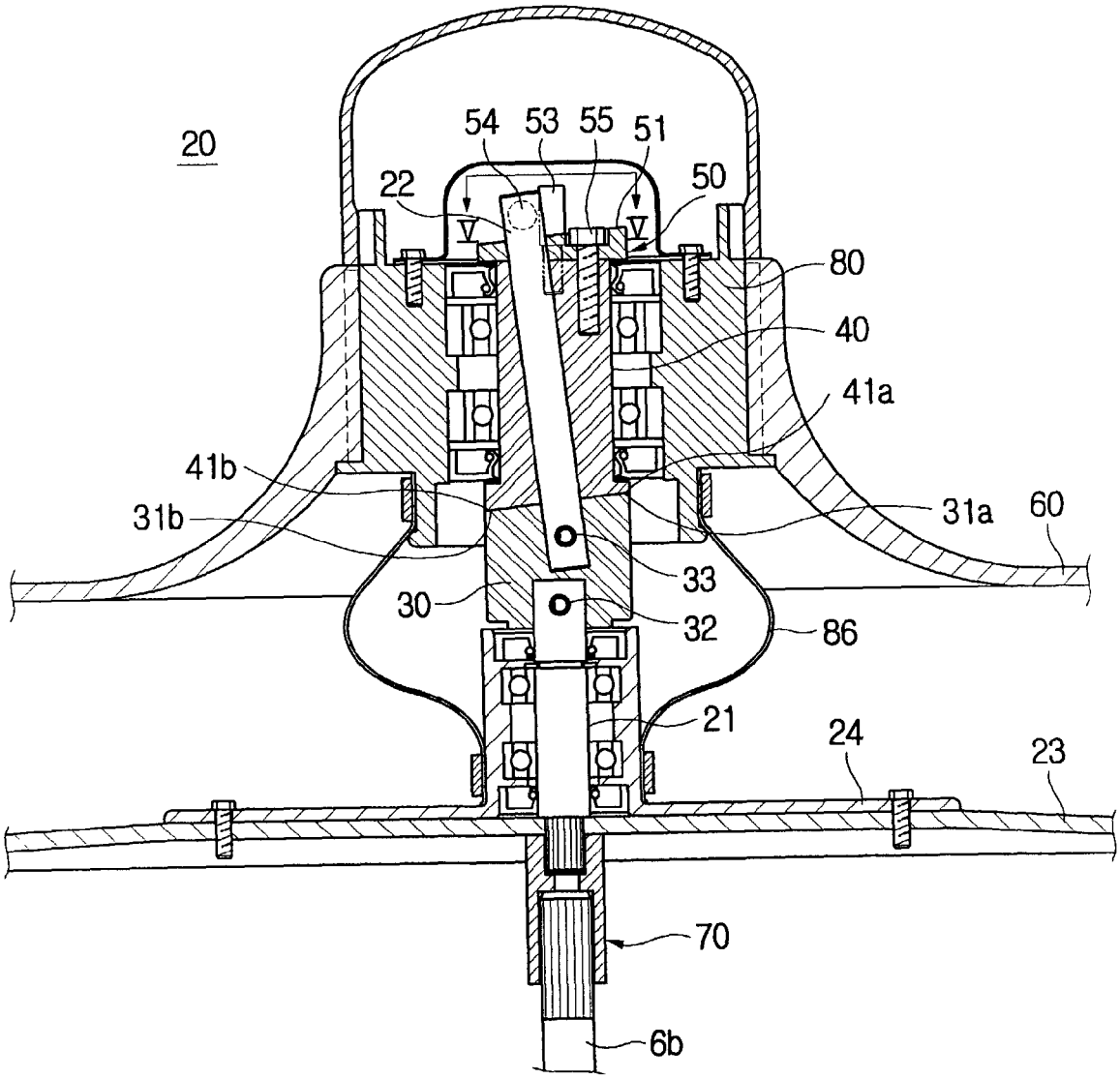
FIG. 4 is a vertical sectional view of the wobbling device in a leveling position according to the embodiment of the present invention.
Figure 5:
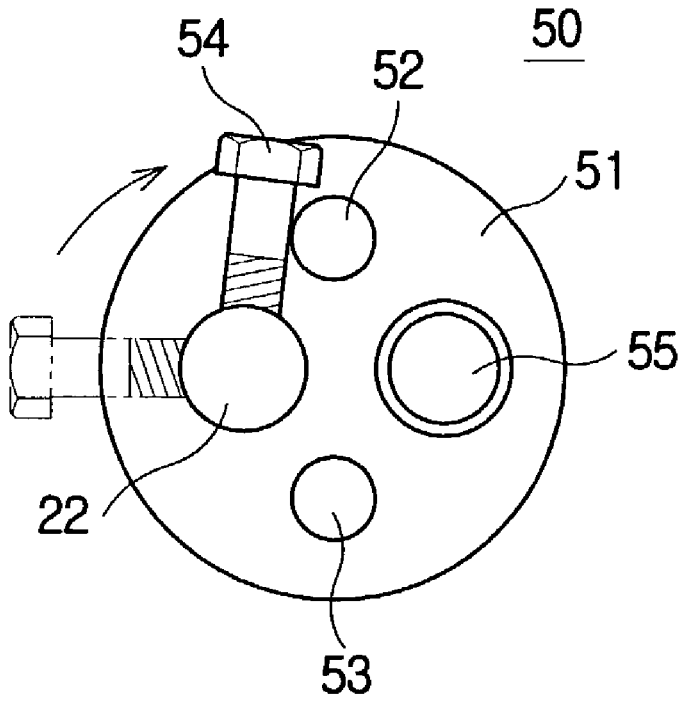
FIG. 5 is a sectional view taken along line V—V of FIG. 4.

FIG. 4 is a vertical sectional view of the wobbling device 20 when the wobbling device 20 is switched to the leveling position, and FIG. 5 shows the arrangement of an actuating unit 50 in the leveling position.

As shown in FIGS. 4 and 5, a vertical rotary shaft 21 is rotatably supported within a housing 24 accommodating the vertical rotary shaft 21. The housing 24 is bolt-connected and fixed to a base 23 having an approximately disc shape (refer to FIG. 2). A lower portion of the vertical rotary shaft 21 and an upper portion of the washing shaft 6*b* are connected to a boss 70 in a spline manner, thereby allowing the vertical rotary shaft 21 to rotate according to a rotation of the washing shaft 6*b*.

An inclined rotary shaft 22 is arranged to penetrate through a hollow rotary body 40 while being inclined at a predetermined angle and to be upwardly and downwardly extended at upper and lower ends of the inclined rotary shaft 22 from the hollow rotary body 40. A gap is formed between the inclined rotary shaft 22 and the hollow rotary body 40, so the inclined rotary shaft 22 can rotate relative to the hollow rotary body 40.

An upper portion of the vertical rotary shaft 21 and an upper portion of the inclined rotary shaft 22 are fixed to a shaft joint 30 by connecting pins 32 and 33, such that both the vertical rotary shaft 21 and the inclined rotary shaft 22 rotate together with the shaft joint 30.

The hollow rotary body 40 is rotatably installed within a supporting member 80, and a washboard 60 is connected to an outer surface of the supporting member 80.

An actuating plate 51 of the actuating unit 50 is fixed to a top of the hollow rotary body 40 by a bolt 55. As shown in FIG. 5, a pair of locking protrusions 52 and 53, which are arranged to be spaced apart from each other at an angle of approximately 180 degrees, are upwardly protruded from a top of the actuating plate 51. Further, an actuating pin 54 is installed while transversely penetrating through an upper portion of the inclined rotary shaft 22, such that the actuating pin 54 is selectively locked to the locking protrusions 52 or 53 according to the rotation of the inclined rotary shaft 22. Thus, the hollow rotary body 40 connected to the actuating plate 51 can rotate.

Therefore, as the inclined rotary shaft 22 rotates in a clockwise direction, the actuating pin 54 in a position indicated by a dotted line in FIG. 5 moves to a position indicated by a solid line to be locked to the locking protrusion 52. Then, as shown in FIG. 4, an upper portion 31*a* of an inclined top surface of the shaft joint 30 comes in contact with an upper portion 41*a* of an inclined bottom surface of the hollow rotary body 40, while a lower portion 31*b* of the inclined top surface of the shaft joint 30 comes into contact with a lower portion 41*b* of the inclined bottom surface of the hollow rotary body 40, thus allowing the top surfaces of both the hollow rotary body 40 and the supporting member 80 to be horizontally positioned. Accordingly, the washboard 60 connected to the supporting member 80 is also horizontally positioned, so the wobbling device 20 maintains a switching state of the wobbling device in the leveling position.

Figure 6:
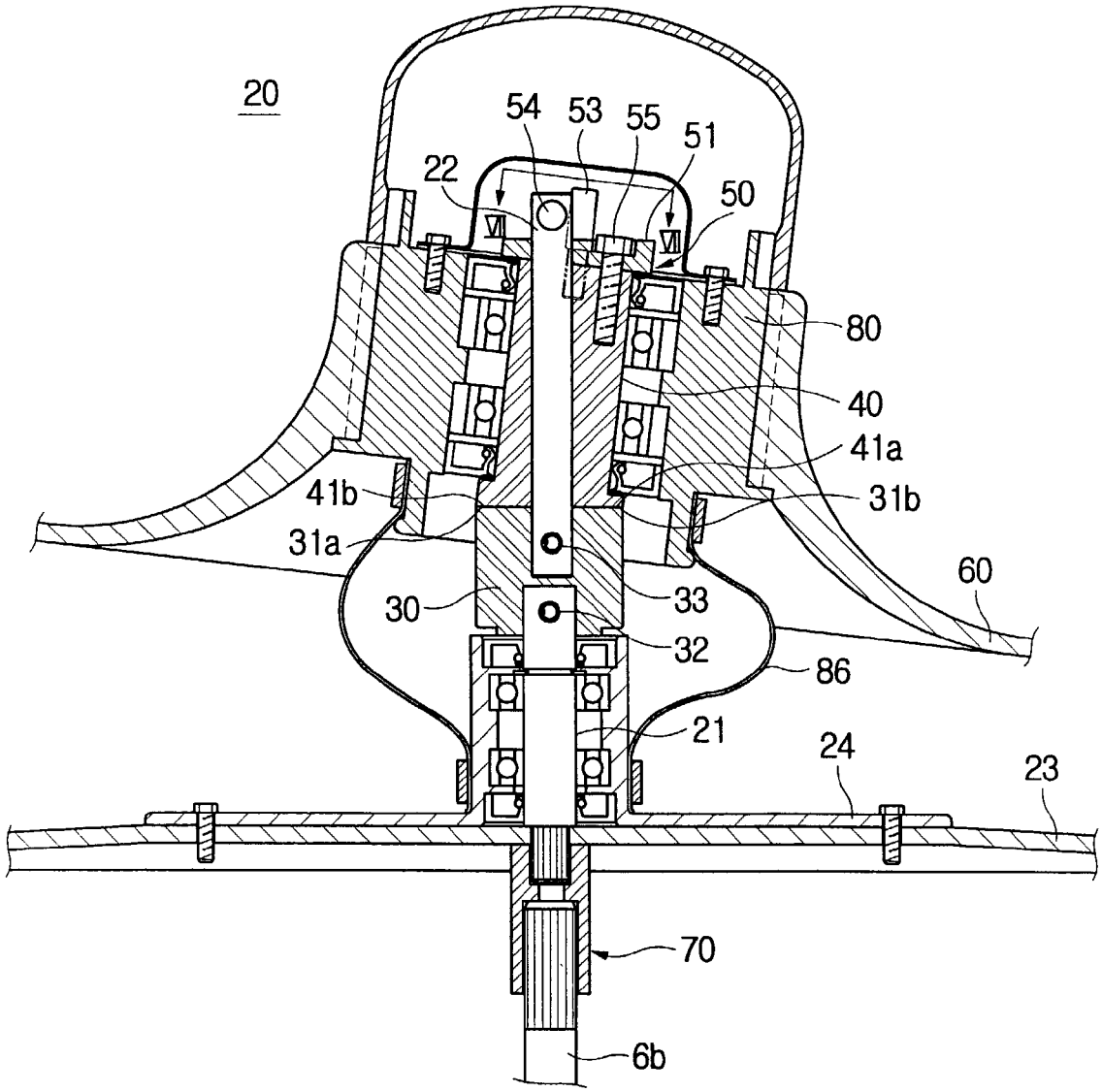
FIG. 6 is a vertical sectional view of the wobbling device in a wobbling position according to the embodiment of the present invention.
Figure 7:
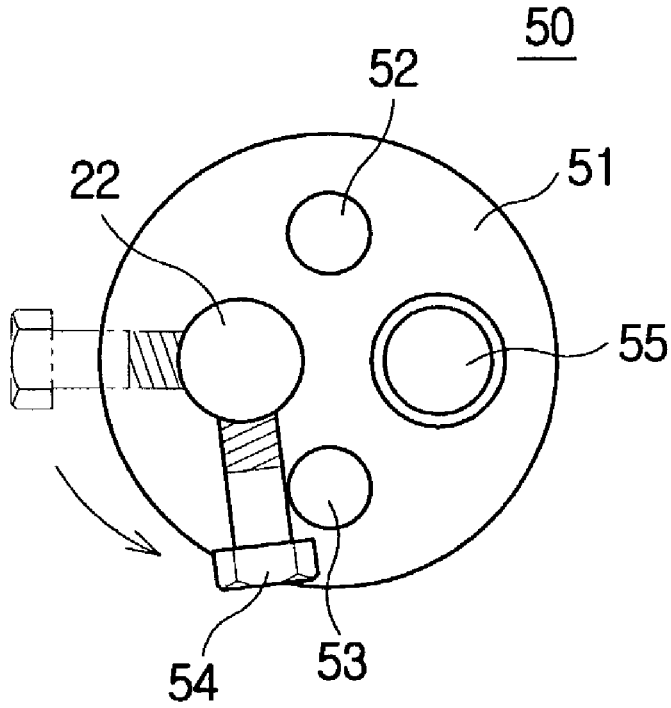
FIG. 7 is a sectional view taken along line VII—VII of FIG. 6.

FIGS. 6 and 7 are contrasted with FIGS. 4 and 5, respectively, wherein FIG. 6 is a vertical sectional view of the wobbling device 20 when the wobbling device 20 is switched from the leveling position to the wobbling position so as to wash laundry by causing the washboard 60 to wobble upwardly and downwardly, and FIG. 7 shows the arrangement of the actuating means 50 in the wobbling position.

Referring to FIG. 7, as the inclined rotary shaft 22 rotates in a counterclockwise direction, the actuating pin 54 of the actuating unit 50, which is in a position indicated by a dotted line, is locked to the locking protrusion 53. Then, as shown in FIG. 6, the upper portion 31*a* of the inclined top surface of the shaft joint 30 comes in contact with the lower portion 41*b* of the inclined bottom surface of the hollow rotary body 40, while the lower portion 31*b* of the inclined top surface of the shaft joint 30 comes in contact with the upper portion 41*a* of the inclined bottom surface of the hollow rotary body 40. Therefore, the top surfaces of the hollow rotary body 40 and the supporting member 80 are positioned to be inclined. Accordingly, the washboard 60 connected to an outer surface of the supporting member 80 is also positioned to be inclined. At this time, when the inclined rotary shaft 22 and the hollow rotary body 40 rotate by a rotation of the washing shaft 6*b*, the washboard 60 wobbles upwardly and downwardly from a current position of the washboard 60 with a predetermined amplitude in response to the rotating speed of the inclined rotary shaft 22.

Hereinafter, a method of controlling a washing machine having the above construction is described in detail with reference to FIGS. 8A to 8F.

Figure 8A:
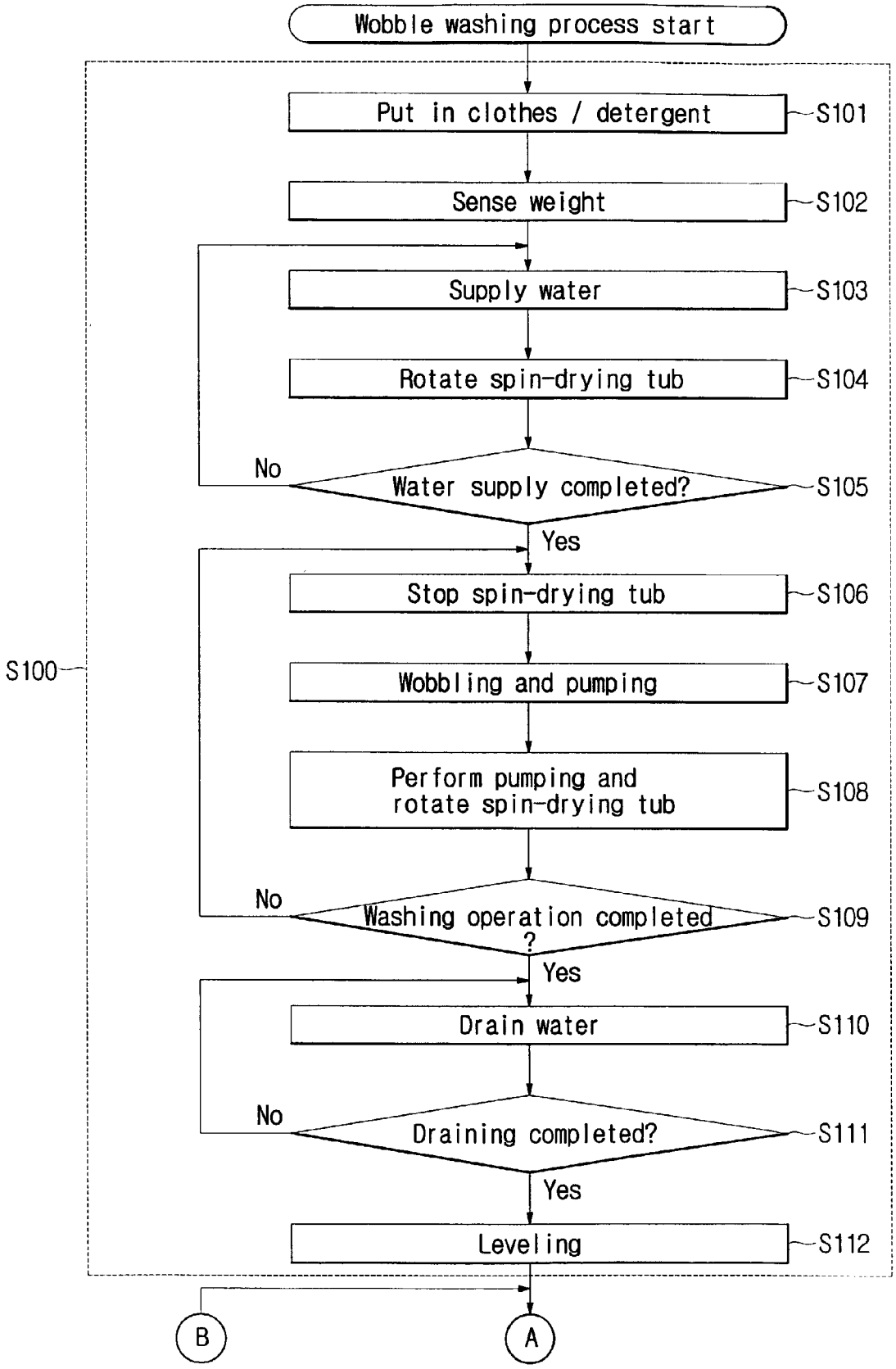

First, a wobble washing process S100, as shown in FIG. 8A, is described.

When a user puts laundry and detergent in the spin-drying tub 3, inputs washing information using the key input unit 101 and manipulates a start key, the control unit 100 outputs a control signal, rotating the spin-drying tub 3 while maintaining the wobbling device 20 in the leveling position, to the drive motor driving unit 105 in response to a key signal corresponding to the start key. Accordingly, the drive motor 5 is driven in a normal direction. In this case, the control unit 100 evaluates a time taken for a driving speed of the drive motor 5 to reach a preset speed using a sensor (not shown) sensing a motor speed. The control unit 100 senses a weight of the laundry according to the evaluated time for a driving speed of the drive motor 5, and stops the drive motor 5 after the sensing of the weight is completed at operations S101 and S102.

The control unit 100 calculates a target level of the water corresponding to the sensed weight of the laundry, and outputs a control signal, opening the water supply valve 13, to the water supply valve driving unit 108. As the water supply valve driving unit 108 opens the water supply valve 13 in response to the control signal from the control unit 100, the supply of the washing water to the washing tub 2 is started at operation S103.

During the supply of the washing water, the control unit 100 outputs a control signal, rotating the spin-drying tub 3 at a low speed, to the drive motor driving unit 105. The drive motor driving unit 105 drives the drive motor 5 in a normal direction so as to rotate the spin-drying tub 3 at the low speed while maintaining the washboard 60 to the leveling position at operation S104. Then, the control unit 100 determines whether the water supply has been completed based on whether the level of washing water, sensed by the water level sensor 102, reaches a calculated target water level at operation S105. If the sensed level of washing water does not reach the target water level according to the determined result, the procedure returns to operation S103 to continuously supply washing water.

If the sensed level of washing water reaches the target water level, and then the water supply is determined to be completed at operation S105, the control unit 100 controls the drive motor driving unit 105 to stop the spin-drying tub 3 at operation S106.

Then, the control unit 100 outputs a control signal causing the washboard 60 to wobble the drive motor driving unit 105. As the drive motor driving unit 105 drives the drive motor 5 in a reverse direction in response to the control signal from the control unit 100, the washboard 60 is driven to the wobbling position. That is, a wobbling operation of applying impacts to the laundry by causing the washboard 60 to wobble upwardly and downwardly while inclining the washboard 60 at a predetermined angle during a washing operation is performed. In this case, the control unit 100 outputs a control signal, driving the circulation pump 11, to the circulation pump driving unit 106. The circulation pump 11 performs an operation of pumping the washing water and the detergent, and circulating the pumped water and the detergent from the lower portion of the washing tub 2 to the upper portion thereof at operation S107.

After performing the wobbling operation for a predetermined period of time, the control unit 100 outputs a control signal, rotating the spin-drying tub 3 at a constant speed, to the drive motor driving unit 105. The drive motor driving unit 105 drives the drive motor 5 in a normal direction in response to the control signal from the control unit 100, such that the washboard 60 rotates together with the spin-drying tub 3 at a constant speed while maintaining the leveling position at operation S108. Further, at operation S108, the pumping operation of circulating the laundry, the detergent and the washing water from the lower portion of the washing tub 2 to the upper portion thereof is continuously performed. Here, the wobbling operation and the spin-drying tub rotating operation are performed several times. The reason is to mix laundry in the upper and the lower portions of the spin-drying tub 3 uniformly such that upper laundry and lower laundry are uniformly washed.

The control unit 100 determines whether the washing operation has been completed based on whether a washing time counted using an internal timer has reached a set time at operation S109. If the counted washing time does not reach the set time according to a determined result, operations S106 to S108 are repeatedly performed.

If the counted washing time has reached the set time, and then completed according to the determined result at operation S109, the control unit 100 outputs a control signal, draining washing water, to the drain valve driving unit 107. The drain valve driving unit 107 opens the drain valve 10 in response to the control signal from the control unit 100, thus enabling the washing water used in the washing operation to be drained to an outside through the drain hose 8 at operation S110.

The control unit 100 determines whether the draining has been completed based whether the level of the washing water, sensed by the water level sensor 102, corresponds to a drained water level at operation S111. If the draining is not completed according to the determined result, the procedure returns to operations S110 to continuously drain water. If the draining has been completed according to the determined result, the control unit 100 controls the drive motor driving unit 105 to maintain the washboard 60 in the leveling position at operation S112.

Figure 8B:
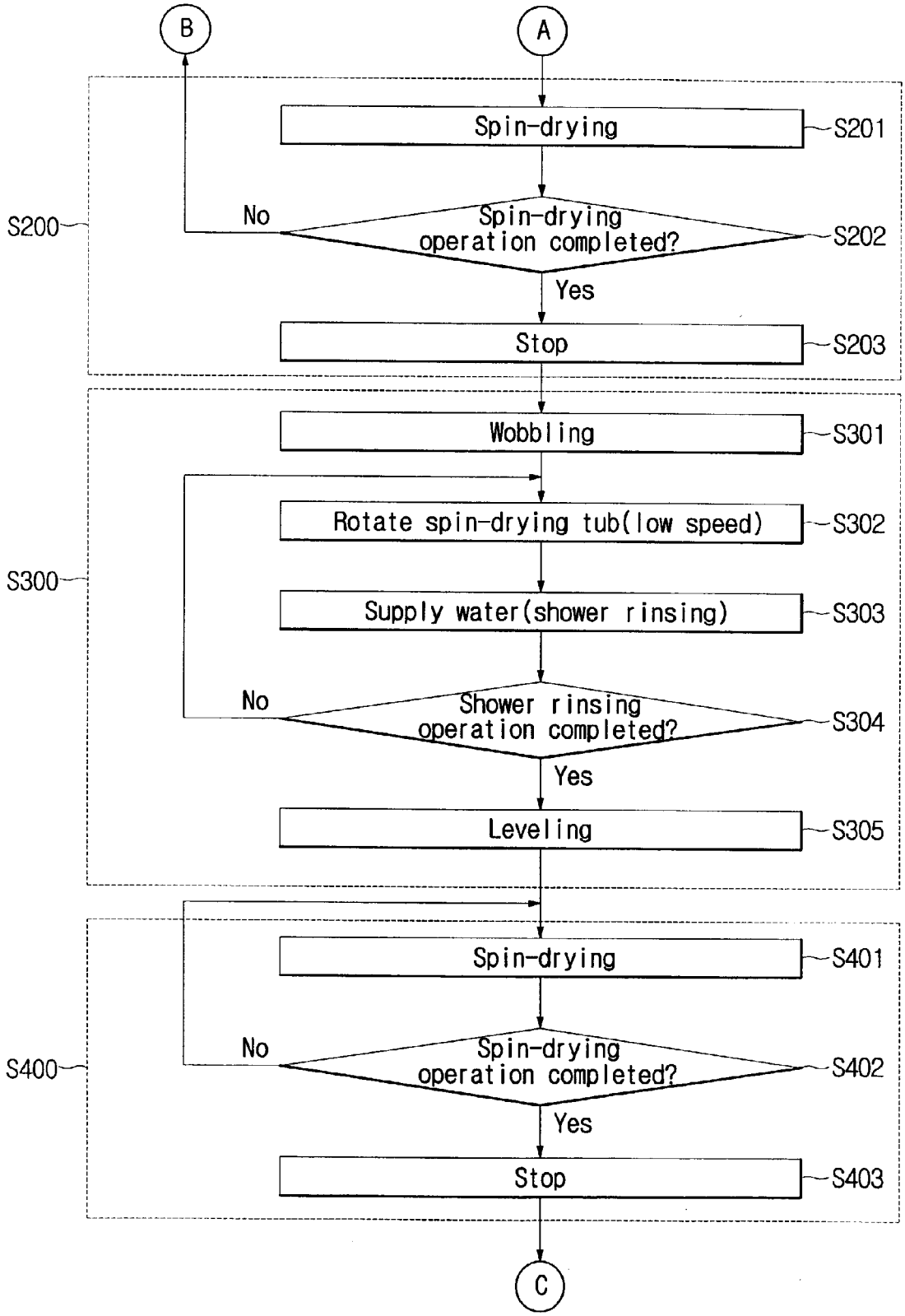

A rinsing drying process S200, as shown in FIG. 8B, executed after the wobble washing process 100, is described.

The control unit 100 outputs a control signal, driving the drive motor 5 in a normal direction to rotate the spin-drying tub 3, to the drive motor driving unit 105. As the drive motor driving unit 105 drives the drive motor 5 in a normal direction, the washboard 60 rotates at a high speed together with the spin-drying tub 3 while maintaining the leveling position of the washboard 60 at operation S201.

The control unit 100 determines whether a spin-drying operation has been completed based on whether a drying time counted using an internal timer has reached a set time at operation S202. If the counted drying time does not reach the set time according to the determined result, the procedure returns to operation S201 to continuously perform the rinsing drying operation. If the counted drying time has reached the set time according to the determined result, the control unit 100 outputs a control signal, stopping the drive motor 5, to the drive motor driving unit 105. As the drive motor driving unit 105 stops the drive motor 5, the rinsing drying operation is completed at operation S203.

A shower rinsing process S300, as shown in FIG. 8B, executed after the rinsing drying process S200, is described.

The control unit 100 outputs a control signal, performing a wobbling operation, to the drive motor driving unit 105. The drive motor driving unit 105 drives the drive motor 5 in a reverse direction, thus causing the washboard 60 to wobble after the washboard 60 is switched to the wobbling position, wherein the wobbling operation is performed for a predetermined period of time at operation S301. The control unit 100 outputs a control signal, rotating the spin-drying tub 3 at a low speed, to the drive motor driving unit 105. As the drive motor driving unit 105 drives the drive motor 5 in a normal direction, the washboard 60 rotates at the low speed together with the spin-drying tub 3 after the washboard 60 is switched to the leveling position at operation S302. Then, the control unit 100 outputs a control signal, performing a shower rinsing operation, to the water supply valve driving unit 108. As the water supply valve driving unit 108 opens the water supply valve 13, the shower rinsing operation of supplying washing water to inside of the spin-drying tub 3 rotating at the low speed is performed at operation S303. The control unit 100 determines whether the shower rinsing operation has been completed based on whether a shower rinsing time counted using an internal timer has reached a set time at operation S304. If the counted shower rinsing time does not reach the set time according to a determined result, the procedure returns to operation S301 to continuously perform the shower rinsing operation.

If the counted shower rinsing time has reached the set time according to the determined result at operation S304, the control unit 100 stops the water supply, and causes the washboard 60 to be switched to the leveling position at operation S304.

A rinsing drying process S400, as shown in FIG. 8B, executed after the shower rinsing process S300 is described.

The control unit 100 outputs a control signal, driving the drive motor 5 in a normal direction so as to rotate the spin-drying tub 3, to the drive motor driving unit 105. As the drive motor driving unit 105 drives the drive motor 5 in a normal direction, the washboard 60 rotates at the high speed together with the spin-drying tub 3 while maintaining the leveling position of the washboard 60 at operation S401.

The control unit 100 determines whether a spin-drying operation has been completed based on whether a drying time counted using an internal timer has reached a set time at operation S402. If the counted drying time does not reach the set time, the procedure returns to operation S401 to continuously perform the rinsing drying operation. If the counted drying time has reached the set time according to the determined result, the control unit 100 outputs a control signal, stopping the drive motor 5, to the drive motor driving unit 105. As the drive motor driving unit 105 stops the drive motor 5, the rinsing drying operation is completed at operation S403.

Figure 8C:
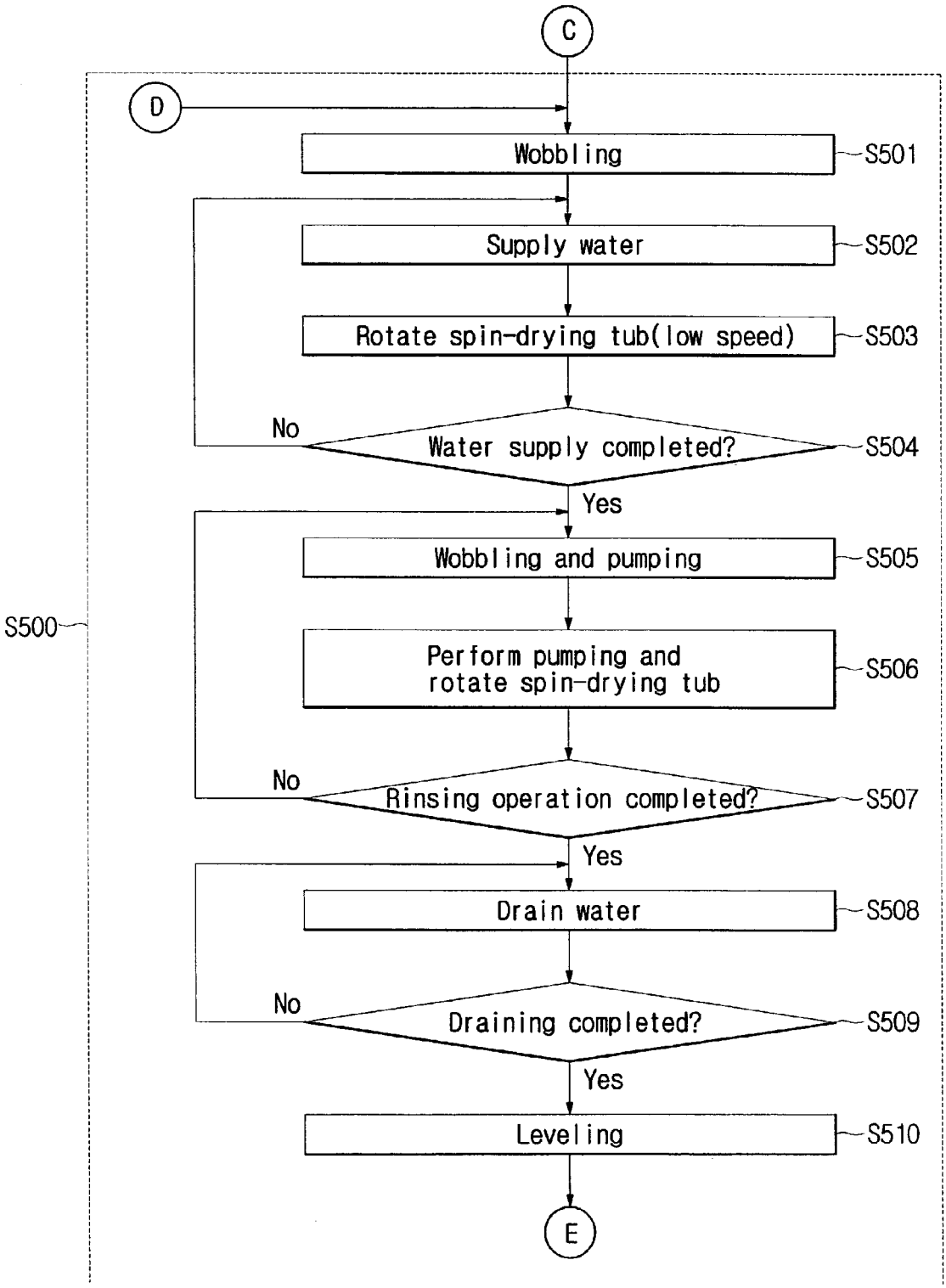
Figure 8D:
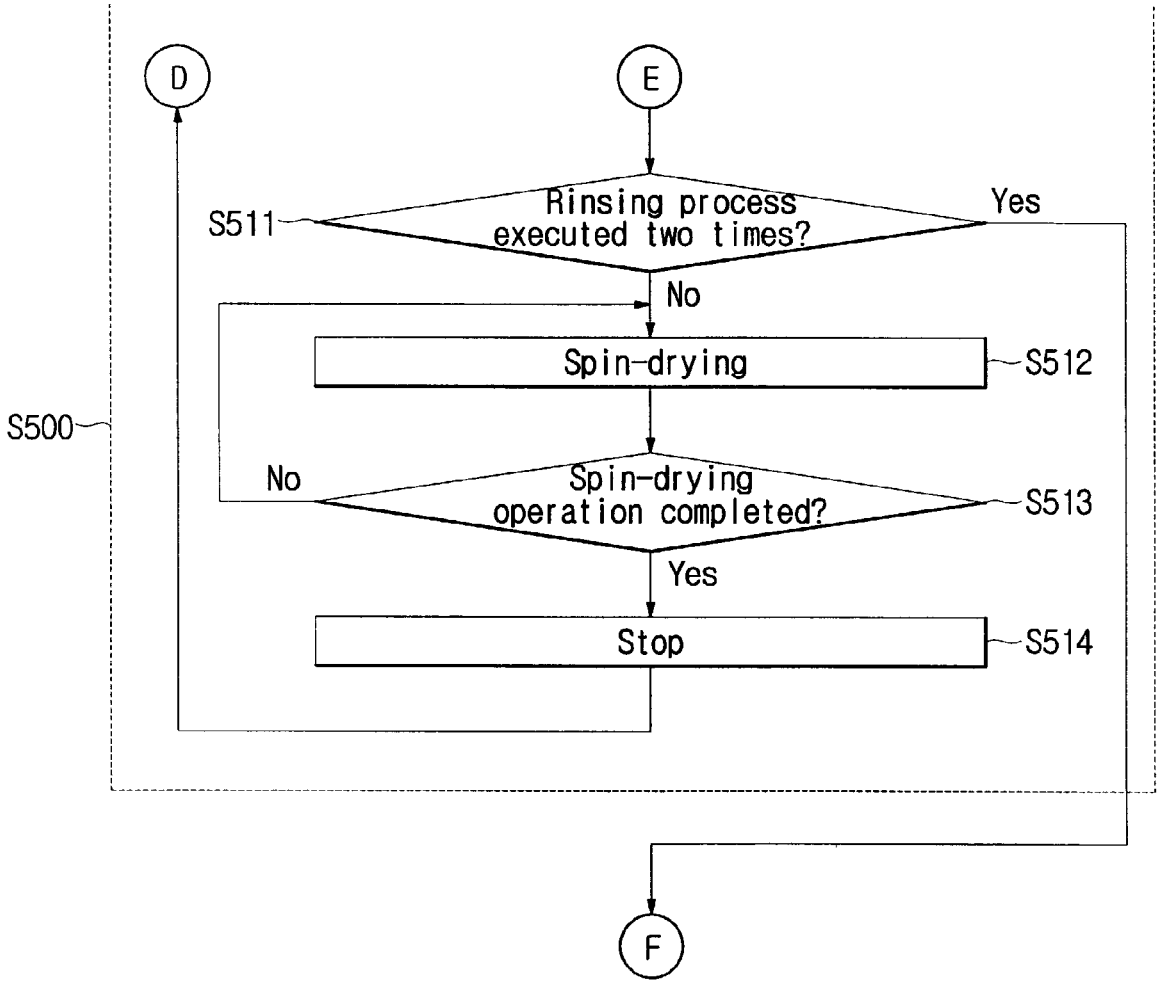

A main rinsing process S500, as shown in FIGS. 8C and 8D, executed after the rinsing drying process S400 is described.

The control unit 100 outputs a control signal, performing a wobbling operation, to the drive motor driving unit 105. The drive motor driving unit 105 drives the drive motor unit 5 in a reverse direction, thus causing the washboard 60 to wobble after the washboard 60 is switched to the wobbling position, wherein the wobbling operation is performed for a predetermined period of time at operation S501, as shown in FIG. 8C. The reason for performing the wobbling operation before the rinsing water is supplied is to prevent entangled laundry from being rinsed in the case where water is supplied after the spin-drying tub 3 rotates.

After the wobbling operation, the control unit 100 outputs a control signal, to supply rinsing water, to the water supply valve driving unit 108. As the water supply valve driving unit 108 opens the water supply valve 13, the rinsing water is supplied to the washing tub 2 at operation S502, as shown in FIG. 8C. During the supply of the rinsing water, the control unit 100 outputs a control signal, rotating the spin-drying tub 3 at the low speed, to the drive motor driving unit 105. As the drive motor driving unit 105 drives the drive motor 5 in a normal direction, the washboard 60 rotates at the low speed together with the spin-drying tub 3 after the washboard 60 is switched to the leveling position at operation S503, as shown in FIG. 8C. The control unit 100 determines whether water supply has been completed based on whether the level of the washing water, sensed by the water level sensor 102, has reached a set water level at operation S504, as shown in FIG. 8C. If the sensed washing water level does not reach the set water level according to a determined result, the procedure returns to operation S502 to continuously supply water.

If the sensed washing water level has reached the set water level, and then the water supply is determined to be completed according to the determined result at operation S504, the control unit 100 outputs a control signal, performing a wobbling operation, to the drive motor driving unit 105. As the drive motor driving unit 105 drives the drive motor 5 in a reverse direction in response to the control signal from the control unit 100, the washboard 60 wobbles upwardly and downwardly to perform a rinsing operation while maintaining a wobbling position of the washboard 60 and an inclined state of the washboard 60. In this case, the circulation pump 11 performs an operation of pumping the water and the detergent from the lower portion of the washing tub 2 to the upper portion thereof at operation S505, as shown in FIG. 8C.

Then, the control unit 100 outputs a control signal, rotating the spin-drying tub 3 at constant speed, to the drive motor driving unit 105. The drive motor driving unit 105 drives the drive motor 5 in a normal direction in response to the control signal from the control unit 100, such that the washboard 60 rotates at constant speed together with the spin-drying tub 3 while maintaining the leveling position of the washboard 60 at operation S506, as shown in FIG. 8C. Further, at operation 506, the pumping operation of driving the circulation pump 11 is continuously performed.

The control unit 100 determines whether a rinsing operation has been completed based on whether a rinsing time counted using an internal timer has reached a set time at operation S507, as shown in FIG. 8C. If the counted rinsing time does not reach the set time, operations S505 and S506 are repeatedly performed.

If the counted rinsing time has reached the set time and then the rinsing operation is determined to be completed according to the determined result at operation S507, the control unit 100 stops the circulation pump 11, and then outputs a control signal, draining rinsing water, to the drain valve driving unit 107. The drain valve driving unit 107 opens the drain valve 10 in response to the control signal from the control unit 100, thereby allowing the rinsing water used in the rinsing operation to be drained to the outside through the drain hose 8 at operation S508, as shown in FIG. 8C.

The control unit 100 determines whether the draining has been completed based on the water level sensed by the water level sensor 102 at operation S509, as shown in FIG. 8C. If the draining is not completed according to a determined result, the procedure returns to operation S508 to continuously drain the water. If the draining has been completed, the control unit 100 outputs a control signal, to level, to the drive motor driving unit 105. As the drive motor driving unit 105 drives the drive motor 5 in a normal direction, the washboard 60 maintains the leveling position of the washboard 60 at operation S510, as shown in FIG. 8C.

The control unit 100 determines whether the main rinsing process has been executed a set number of times (for example, two times) at operation S511, as shown in FIG. 8D. If the main rinsing process is not executed a set number of times, the control unit 100 outputs a control signal, rotating the spin-drying tub 3 at high speed, to the drive motor driving unit 105. As the drive motor driving unit 105 drives the drive motor 5 in a normal direction at the high speed, the washboard 60 rotates together with the spin-drying tub 3 at the high speed while maintaining the leveling position of the washboard 60 at operation S512.

The control unit 100 determines whether a spin-drying operation has been completed based on whether a drying time counted using an internal timer has reached a set time at operation S513, as shown in FIG. 8D. If the counted drying time does not reach the set time, the procedure returns to operation S512, as shown in FIG. 8D, to continuously perform the spin-drying operation. If the counted drying time has reached the set time, the control unit 100 outputs a control signal, stopping the drive motor 5, to the drive motor driving unit 105. As the drive motor driving unit 105 stops the drive motor 5, the spin-drying operation is completed at operation S514, as shown in FIG. 8D, and the procedure returns to operation S501 for a next wobbling operation. So, the main rinsing process S500 is continuously executed thereafter.

Figure 8E:
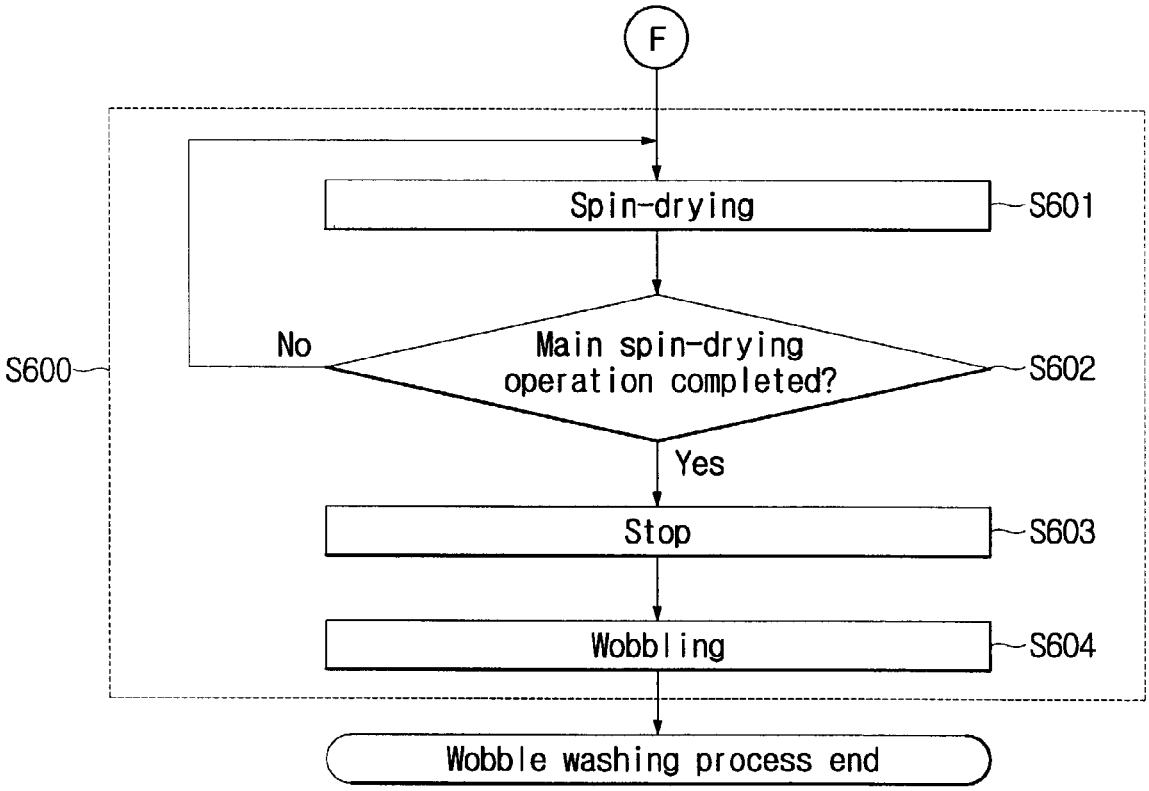

If the main rinsing process S500 has been executed a set number of times (for example, two times) according to the determined result at operation S511, a main spin-drying process S600, as shown in FIG. 8E, is executed and is described.

The control unit 100 outputs a control signal, performing a spin-drying operation, to the drive motor driving unit 105. As the drive motor driving unit 105 drives the drive motor 5 in a normal direction, the washboard 60 rotates together with the spin-drying tub 3 at high speed while maintaining the leveling position of the washboard 60 at operation S601.

The control unit 100 determines whether the main spin-drying operation has been completed based on whether a drying time counted using an internal counter has reached a set time at operation S602. If the counted drying time does not reach the set time, the procedure returns to operation S601 to continuously perform the spin-drying operation. If the counted drying time has reached the set time, the control unit 100 outputs a control signal, stopping the drive motor 5, to the drive motor driving unit 105. As the drive motor driving unit 105 stops the drive motor 5, the main spin-drying operation is completed at operation S603. When the main spin-drying operation is completed, the control unit 100 outputs a control signal, performing a wobbling operation, to the drive motor driving unit 105 at operation S604. In this case, the reason to perform the wobbling operation after the spin-drying operation is completed is to allow the user to easily take out the laundry by causing the washboard to wobble to loosen the laundry in the spin-drying tub 3. A further reason is to minimize the generation of wrinkles of the laundry, although the user does not take out the laundry immediately after the spin-drying operation, and a certain period of time elapses.

As described above, a method of controlling a washing machine is provided, which performs an operation of causing a washboard to wobble in a wobbling position and an operation of rotating a spin-drying tub in a washing process several times to mix laundry, such that upper laundry and lower laundry can be uniformly washed, thus improving a laundry cleaning performance. Further, the present invention can prevent entangled laundry from being rinsed by causing the washboard to wobble in the wobbling position before rinsing water is supplied. Further, the present invention can allow the user to easily take out the laundry and reduce the generation of wrinkles of the laundry by causing the washboard to wobble in the wobbling position after a spin-drying process is completed, and then loosening the laundry in the spin-drying tub.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A method of controlling a washing machine having a washboard, the washing machine executing a disentangling process to disentangle laundry after a washing process using a wobbling device, the disentangling process comprising:

alternately performing an operation of causing the washboard to wobble and an operation of rotating a spin-drying tub, wherein the wobbling operation is initiated immediately after the rotation operation of the spin-drying tub is completed and immediately before water is applied to laundry in the spin-drying tub to disentangle the laundry.

2. The washing machine control method according to claim 1, wherein the operation of causing the washboard to wobble includes the washboard wobbling upwardly and downwardly from a current position of the washboard with a predetermined amplitude in response to a rotating speed of an inclined rotary shaft.

3. The washing machine control method according to claim 1, wherein the washing process includes sensing a weight of laundry to be washed and supplying washing water in accordance with the sensed weight of the laundry.

4. The washing machine control method according to claim 1, wherein the operation of causing the washboard to wobble includes simultaneously inclining the washboard to an inclined position, with respect to a horizontal surface, and wobbling the washboard upwardly and downwardly from the inclined position.

5. A method of controlling a washing machine having a spin-drying tub and a washboard, the washing machine executing a disentangling process to disentangle laundry after a washing process and before a rinsing process with a wobbling device, the disentangling process comprising:

rotating the spin-drying tub after the washing process is completed;

causing the washboard to begin wobbling immediately after rotation of the spin-drying tub is completed and immediately before the rinsing process is initiated to disentangle the laundry; and supplying water to be used in the rinsing process.

6. The washing machine control method according to claim 5, wherein the causing the washboard to wobble includes wobbling the washboard upwardly and downwardly from a current position of the washboard with a predetermined amplitude in response to a rotating speed of an inclined rotary shaft.

7. The washing machine control method according to claim 5, wherein upper and lower laundry are substantially uniformly washed.

8. The washing machine control method according to claim 5, wherein the causing the washboard to wobble includes simultaneously inclining the washboard to an inclined position, with respect to a horizontal surface, and wobbling the washboard upwardly and downwardly from the inclined position.

9. The washing machine control method according to claim 5, wherein said supplying water comprises:

sensing a water supply level;

calculating a target water level based on the sensed water supply level; and determining whether to continuously supply washing water according to the calculated target water level.

10. The washing machine control method according to claim 5, wherein the rotating the spin-drying tub comprises leveling the wobbling device prior to rotation of the spin-drying tub.

11. The washing machine control method according to claim 10, wherein when the spin-drying tub is rotated, the wobbling device is prevented from wobbling by the leveling.

12. The washing machine control method according to claim 5, wherein the rotating the spin-drying tub and the causing the washboard to wobble are performed whenever the rinsing process is repeatedly executed.

13. The washing machine control method according to claim 5, further comprising alternatively performing the step of causing the washboard to wobble using the wobbling device and the step of rotating the spin-drying tub in the washing process.

14. A method of controlling a washing machine having a washboard, the washing machine executing a spin-drying process, executing a disentangling process to disentangle laundry with a wobbling device, and applying water to the laundry, the disentangling process comprising:

causing the washboard to wobble using the wobbling device to disentangle laundry immediately after the spin-drying process is completed, and immediately before water is applied to laundry in the washing machine.

15. The washing machine control method according to claim 14, wherein during the spin-drying process, the wobbling device is prevented from wobbling by leveling the wobbling device.

16. A method of controlling a washing machine having a spin-drying tub and a washboard, the washing machine executing a disentangling process to disentangle laundry after a washing process, a rinsing process and a spin-drying process with a wobbling device, the method comprising:

alternately performing an operation of causing the washboard to wobble using the wobbling device and an operation of rotating the spin-drying tub in the washing process;

rotating the spin-drying tub after the washing process is completed;

causing the washboard to begin wobbling immediately after the rotating of the spin-drying tub is completed and immediately before the rinsing process is initiated to disentangle laundry in the disentangling process;

supplying water to be used in the rinsing process; and causing the washboard to wobble after the spin-drying process is completed to disentangle laundry in the disentangling process.

17. The washing machine control method according to claim 16, wherein both of the rotating the spin-drying tub and the causing the washboard to wobble after the rotating the spin-drying tub are performed whenever the rinsing process is repeatedly executed.

18. The washing machine control method according to claim 16, wherein the operation of causing the washboard to wobble includes the washboard wobbling upwardly and downwardly from a current position of the washboard with a predetermined amplitude in response to a rotating speed of an inclined rotary shaft.

19. The washing machine control method according to claim 16, wherein the operation of causing the washboard to wobble includes simultaneously inclining the washboard to an inclined position, with respect to a horizontal surface, and wobbling the washboard upwardly and downwardly from the inclined position.

20. A method of controlling a washing machine having a spin-drying tub and a washboard, the washing machine executing a disentangling process to disentangle laundry after a washing process with a wobbling device, the disentangling process comprising:

performing a wobbling operation to disentangle laundry, using the wobbling device immediately before rinsing water is supplied, to prevent laundry from being entangled if water is supplied after the spin-drying tub rotates.

21. A method of controlling a washing machine having a spin-drying tub and a washboard, the washing machine executing a disentangling process to disentangle laundry with a wobbling device, the disentangling process comprising:

performing a wobbling operation, using the wobbling device causing the washboard to wobble immediately after the spin-drying operation is completed and immediately before water is applied to laundry, to disentangle laundry in the spin-drying tub.

22. A method of controlling a washing machine having a spin-drying tub containing laundry and a washboard, the washing machine executing a shower rinsing process, a rinsing drying process and a main rinsing process with a wobbling device, comprising:

rotating the spin drying tub in the rinsing drying process after the shower rinsing process is complete;

causing the washboard to wobble using the wobbling device immediately before and during the main rinsing process and after the rinsing drying process is completed to disentangle the laundry; and rotating the spin-drying tub in the main rinsing process after causing the washboard to wobble.

23. The washing machine control method according to claim 22, further comprising:

causing the washboard to wobble using the wobbling device in the shower rinsing process after rotation of the spin-drying tub in the main rinsing process is completed;

rotating the spin-drying tub in the shower rinsing process after causing the washboard to wobble; and supplying water in the shower rinsing process after rotating the spin-drying tub supplying water.

24. A method of controlling a washing machine having a spin-drying tub and a washboard, the washing machine executing a main rinsing process, a disentangling process, and a shower rinsing process with a wobbling device, comprising:

causing the washboard to wobble immediately before the shower rinsing process using the wobbling device and immediately after rotation of the spin-drying tub in the main rinsing process is completed to disentangle laundry;

causing the washboard to wobble during the shower rinsing process;

rotating the spin-drying tub in the shower rinsing process after causing the washboard to wobble; and supplying water in the shower rinsing process after rotating the spin-drying tub supplying water.

25. A method of controlling a washing machine having a washboard, the washing machine executing a disentangling process with a wobbling device, the method comprising:

placing laundry in the washing machine;

starting the washing machine by sending a control signal to a motor driving unit;

rotating a spin-drying tub using the motor driving unit while maintaining the wobbling device in a level position sensing a weight of laundry to be washed based on evaluating a time taken for a driving speed of the drive motor to reach a preset speed;

supplying washing water in accordance with the sensed weight of the laundry; and alternately performing an operation of causing the washboard to wobble and an operation of rotating a spin-drying tub, wherein the wobbling operation is initiated immediately after the rotation operation of the spin-drying tub is completed and immediately before water is applied to laundry in the spin-drying tub to disentangle laundry.

26. The washing machine control method according to claim 25, wherein the step of supplying washing water further comprises:

calculating a target level of the water corresponding to the sensed weight of the laundry;

opening a water supply valve; and supplying washing water in accordance with the calculated target level of water.

* * * * *

UNITED STATES PATENT AND TRADEMARK OFFICE

CERTIFICATE OF CORRECTION

PATENT NO. : 7,171,714 B2
APPLICATION NO. : 10/216238
DATED : February 6, 2007
INVENTOR(S) : Sang-yeon Pyo et al.

It is certified that error appears in the above-identified patent and that said Letters Patent is hereby corrected as shown below:

Column 14, Line 54, after "position" insert --;--.

Signed and Sealed this

Fifteenth Day of May, 2007

JON W. DUDAS
*Director of the United States Patent and Trademark Office*